US008864454B2

(12) United States Patent
Hofer et al.

(10) Patent No.: US 8,864,454 B2
(45) Date of Patent: Oct. 21, 2014

(54) SYSTEM AND METHOD OF ASSEMBLING A SUPERSONIC COMPRESSOR SYSTEM INCLUDING A SUPERSONIC COMPRESSOR ROTOR AND A COMPRESSOR ASSEMBLY

(75) Inventors: Douglas Carl Hofer, Clifton Park, NY (US); Vittorio Michelassi, Munich (DE)

(73) Assignee: General Electric Company, Niskayuna, NY (US)

( * ) Notice: Subject to any disclaimer, the term of this patent is extended or adjusted under 35 U.S.C. 154(b) by 1029 days.

(21) Appl. No.: 12/914,342

(22) Filed: Oct. 28, 2010

(65) Prior Publication Data

US 2012/0107106 A1 May 3, 2012

(51) Int. Cl.

| | |
|---|---|
| ***F01D 5/14*** | (2006.01) |
| ***F04D 17/12*** | (2006.01) |
| ***F04D 21/00*** | (2006.01) |
| ***F04D 29/64*** | (2006.01) |
| ***F04D 29/44*** | (2006.01) |

(52) U.S. Cl.

CPC ..... *F04D 21/00* (2013.01); *F04D 17/12* (2013.01); *F04D 29/644* (2013.01); *F04D 29/441* (2013.01)

USPC ..... 415/181; 415/62; 415/66

(58) Field of Classification Search

USPC ..... 415/181, 62, 66, 120, 198.1, 199.1, 415/199.2, 199.4, 199.5, 60, 68; 416/198 R, 416/198 A, 120

See application file for complete search history.

(56) References Cited

U.S. PATENT DOCUMENTS

| | | | | |
|---|---|---|---|---|
| 2,648,493 | A * | 8/1953 | Stalker | 415/62 |
| 2,804,747 | A * | 9/1957 | Pavlecka | 60/792 |
| 2,925,952 | A | 2/1960 | Garve | |
| 2,991,929 | A * | 7/1961 | Stalker | 415/181 |
| 3,305,165 | A * | 2/1967 | Gregory | 415/145 |
| 4,012,166 | A | 3/1977 | Kaesser et al. | |
| 4,199,296 | A | 4/1980 | de Chair | |
| 4,463,772 | A | 8/1984 | Ball | |

(Continued)

FOREIGN PATENT DOCUMENTS

| | | |
|---|---|---|
| EP | 1126133 A2 | 8/2001 |
| GB | 885661 | 12/1961 |
| WO | 2009025803 A1 | 2/2009 |

OTHER PUBLICATIONS

Shawn P. Lawlor and Peter Baldwin, Conceptual Design of a Supersonic CO2 Compressor, Proceedings of ASME 2005, ASME Turbo Expo 2005, Jun. 6-9, 2005, 8 pages, Ramgen Power Systems, Bellevue, WA.

(Continued)

*Primary Examiner* — Dwayne J White
(74) *Attorney, Agent, or Firm* — Andrew J. Caruso

(57) ABSTRACT

A supersonic compressor system. The supersonic compressor system includes a casing that defines a cavity that extends between a fluid inlet and a fluid outlet, and a first drive shaft that is positioned within the cavity. A centerline axis extends along a centerline of the first drive shaft. A supersonic compressor rotor is coupled to the first drive shaft and is positioned in flow communication between the fluid inlet and the fluid outlet. The supersonic compressor rotor includes at least one supersonic compression ramp that is configured to form at least one compression wave for compressing a fluid. A centrifugal compressor assembly is positioned in flow communication between the supersonic compressor rotor and the fluid outlet. The centrifugal compressor assembly is configured to compress fluid received from the supersonic compressor rotor.

19 Claims, 11 Drawing Sheets

(56) References Cited

U.S. PATENT DOCUMENTS

| | | | |
|---|---|---|---|
| 4,620,679 | A | 11/1986 | Karanian |
| 4,704,861 | A | 11/1987 | Mowill |
| 5,525,038 | A | 6/1996 | Sharma et al. |
| 5,881,758 | A | 3/1999 | Koncsek et al. |
| 6,358,003 | B2 | 3/2002 | Schlechtriem |
| 6,428,271 | B1 | 8/2002 | Ress, Jr. et al. |
| 6,488,469 | B1 | 12/2002 | Yousser et al. |
| 7,070,388 | B2 | 7/2006 | Meng et al. |
| 7,293,955 | B2 | 11/2007 | Lawlor et al. |
| 7,296,396 | B1 | 11/2007 | Wilson et al. |
| 7,334,990 | B2 | 2/2008 | Lawlor et al. |
| 7,337,606 | B2 | 3/2008 | Brouillette et al. |
| 7,434,400 | B2 | 10/2008 | Lawlor et al. |
| 2009/0107557 | A1 | 4/2009 | Conners |
| 2009/0196731 | A1 | 8/2009 | Lawlor |
| 2010/0005763 | A1 | 1/2010 | Bloom |
| 2010/0043389 | A1 | 2/2010 | Conners |
| 2010/0232953 | A1 * | 9/2010 | Anderson et al. ..... 415/199.2 |

OTHER PUBLICATIONS

H.J. Lichtfuss, H. Starken, Supersonic Cascade Flow, Progress in Aerospace Sciences vol. 15, 1974, pp. 37-149.

M. F. El-Dosoky, A. Rona and J. P. Gostelow, An Analytical Model for Over-Shroud Leakage Losses in a Shrouded Turbine Stage, ASME Turbo Expo 2007, Power for Land, Sea and Air, GT2007, May 2007, pp. 1-10, Montreal Canada.

Allan D. Grosvenor, David A. Taylor, Jonathan R. Bucher, Michael J. Aarnio, Paul M. Brown, Robert D. Draper, Shawn P. Lawlor, Measured and Predicted Performance of a High Pressure Ratio Supersonic Compressor Rotor, ASME Turbo Expo 2008, Power for Land, Sea and Air, GT2008, Jun. 2008, pp. 1-12, Berlin, Germany.

* cited by examiner

SYSTEM AND METHOD OF ASSEMBLING A SUPERSONIC COMPRESSOR SYSTEM INCLUDING A SUPERSONIC COMPRESSOR ROTOR AND A COMPRESSOR ASSEMBLY

BACKGROUND OF THE INVENTION

The subject matter described herein relates generally to supersonic compressor systems and, more particularly, to a supersonic compressor systems that include a supersonic compressor rotor and a compressor assembly.

At least some known supersonic compressor systems include a drive assembly, a drive shaft, and at least one supersonic compressor rotor for compressing a fluid. The drive assembly is coupled to the supersonic compressor rotor with the drive shaft to rotate the drive shaft and the supersonic compressor rotor.

At least some known supersonic compressor assemblies include an axial-flow supersonic compressor rotor. Known supersonic compressor rotors include a plurality of strakes coupled to a rotor disk. Each strake is oriented circumferentially about the rotor disk and define an axial flow channel between adjacent strakes. At least some known supersonic compressor rotors include a supersonic compression ramp that is coupled to the rotor disk. Known supersonic compression ramps are positioned within the axial flow path and are configured to form a compression wave within the flow path.

During operation of known supersonic compressor systems, the drive assembly rotates the supersonic compressor rotor at a high rotational speed. A fluid is channeled to the supersonic compressor rotor such that the fluid is characterized by a velocity that is supersonic with respect to the supersonic compressor rotor at the flow channel. At least some known supersonic compressor rotors discharge fluid from the flow channel in an axial direction. As fluid is channeled in an axial direction, supersonic compressor system components downstream of the supersonic compressor rotor are required to be designed to receive axial flow. As such, an efficiency in compressing a fluid may be limited to the efficiency of the axial-flow supersonic compressor rotor. Known supersonic compressor systems are described in, for example, U.S. Pat. Nos. 7,334,990 and 7,293,955 filed Mar. 28, 2005 and Mar. 23, 2005 respectively, and United States Patent Application 2009/0196731 filed Jan. 16, 2009.

BRIEF DESCRIPTION OF THE INVENTION

In one embodiment, a supersonic compressor system is provided. The supersonic compressor system includes a casing that defines a cavity that extends between a fluid inlet and a fluid outlet, and a first drive shaft that is positioned within the cavity. A centerline axis extends along a centerline of the first drive shaft. A supersonic compressor rotor is coupled to the first drive shaft and is positioned in flow communication between the fluid inlet and the fluid outlet. The supersonic compressor rotor includes at least one supersonic compression ramp that is configured to form at least one compression wave for compressing a fluid. A centrifugal compressor assembly is positioned in flow communication between the supersonic compressor rotor and the fluid outlet. The centrifugal compressor assembly is configured to compress fluid received from the supersonic compressor rotor.

In another embodiment, a supersonic compressor system is provided. The supersonic compressor system includes a casing that defines a cavity that extends between a fluid inlet and a fluid outlet, and a first drive shaft that is positioned within the cavity. A centerline axis extends along a centerline of the first drive shaft. A supersonic compressor rotor is coupled to the first drive shaft and is positioned in flow communication between the fluid inlet and the fluid outlet. The supersonic compressor rotor includes at least one supersonic compression ramp that is configured to form at least one compression wave for compressing a fluid. An axial compressor assembly is positioned in flow communication between the supersonic compressor rotor and the fluid outlet. The axial compressor assembly is configured to compress fluid received from the supersonic compressor rotor.

In a further embodiment, a supersonic compressor system is provided. The supersonic compressor system includes a casing that defines a cavity that extends between a fluid inlet and a fluid outlet, and a first drive shaft that is positioned within the cavity. A centerline axis extends along a centerline of the first drive shaft. A supersonic compressor rotor is coupled to the first drive shaft and is positioned in flow communication between the fluid inlet and the fluid outlet. The supersonic compressor rotor includes at least one supersonic compression ramp that is configured to form at least one compression wave for compressing a fluid. A mixed-flow compressor assembly is positioned in flow communication between the supersonic compressor rotor and the fluid outlet. The mixed-flow compressor assembly is configured to compress fluid received from the supersonic compressor rotor.

In yet another embodiment, a method of assembling a supersonic compressor system is provided. The method includes providing a casing that defines a cavity that extends between a fluid inlet and a fluid outlet. A first drive shaft is coupled to a driving assembly. The first drive shaft is at least partially positioned within the cavity. A supersonic compressor rotor is coupled to the first drive shaft. The supersonic compressor rotor includes at least one supersonic compression ramp that is configured to form at least one compression wave for compressing a fluid. A compressor assembly is coupled in flow communication between the supersonic compressor rotor and the fluid outlet. The compressor assembly is configured to compress fluid received from the supersonic compressor rotor.

BRIEF DESCRIPTION OF THE DRAWING

These and other features, aspects, and advantages of the present invention will become better understood when the following detailed description is read with reference to the accompanying drawings in which like characters represent like parts throughout the drawings, wherein.

Figure 1:
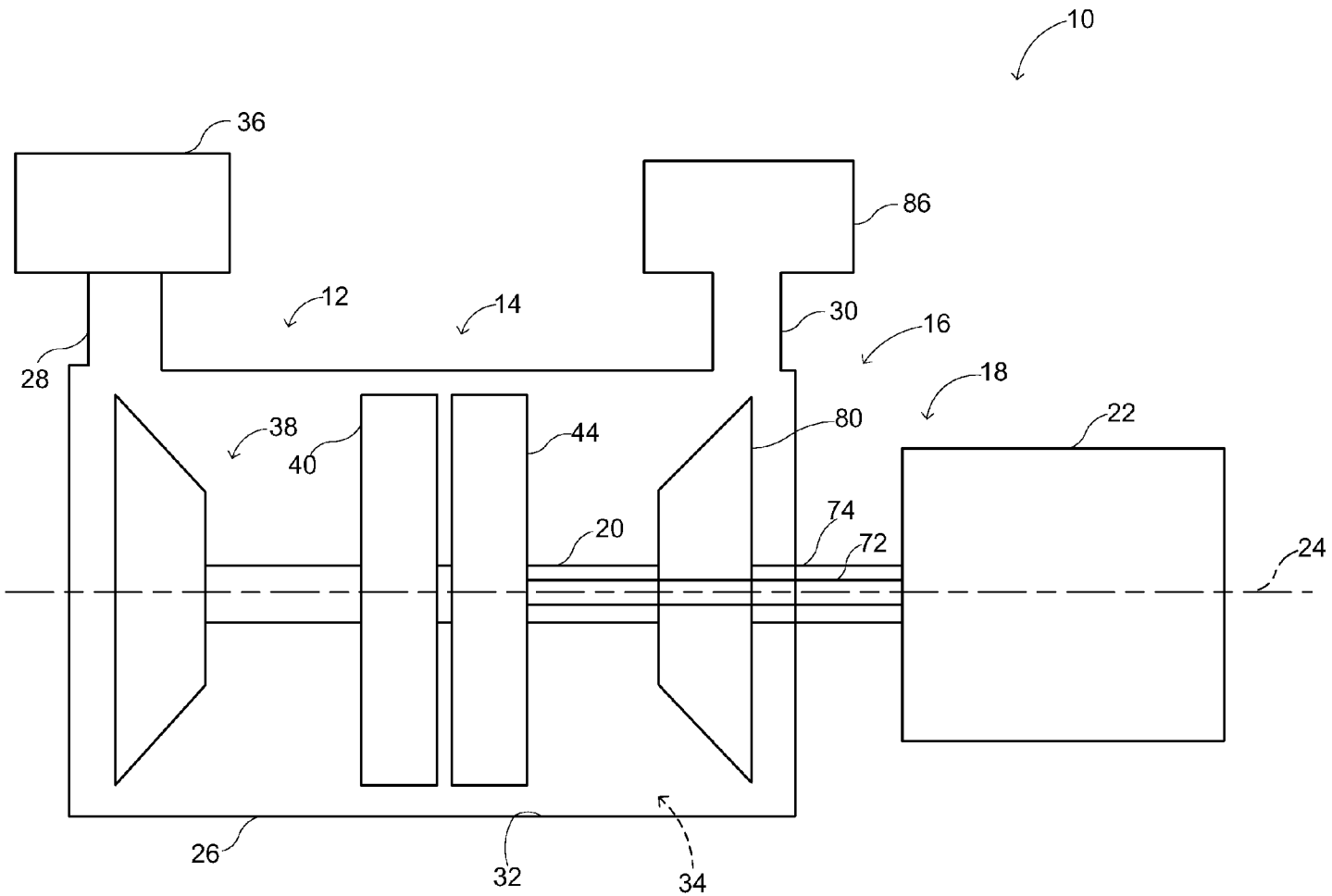
FIG. 1 is a schematic view of an exemplary supersonic compressor system.

Unless otherwise indicated, the drawings provided herein are meant to illustrate key inventive features of the invention. These key inventive features are believed to be applicable in a wide variety of systems comprising one or more embodiments of the invention. As such, the drawings are not meant to include all conventional features known by those of ordinary skill in the art to be required for the practice of the invention.

DETAILED DESCRIPTION OF THE INVENTION

In the following specification and the claims, which follow, reference will be made to a number of terms, which shall be defined to have the following meanings.

The singular forms "a", "an", and "the" include plural referents unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about" and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

As used herein, the term "supersonic compressor rotor" refers to a compressor rotor comprising a supersonic compression ramp disposed within a fluid flow channel of the supersonic compressor rotor. Supersonic compressor rotors are said to be "supersonic" because they are designed to rotate about an axis of rotation at high speeds such that a moving fluid, for example a moving gas, encountering the rotating supersonic compressor rotor at a supersonic compression ramp disposed within a flow channel of the rotor, is said to have a relative fluid velocity which is supersonic. The relative fluid velocity can be defined in terms of the vector sum of the rotor velocity at the supersonic compression ramp and the fluid velocity just prior to encountering the supersonic compression ramp. This relative fluid velocity is at times referred to as the "local supersonic inlet velocity", which in certain embodiments is a combination of an inlet gas velocity and a tangential speed of a supersonic compression ramp disposed within a flow channel of the supersonic compressor rotor. The supersonic compressor rotors are engineered for service at very high tangential speeds, for example tangential speeds in a range of 300 meters/second to 800 meters/second.

The exemplary systems and methods described herein overcome disadvantages of known supersonic compressor assemblies by providing a supersonic compressor system that includes a supersonic compressor rotor coupled to a compressor assembly to facilitate increasing efficiency in compressing a fluid. More specifically, the embodiments described herein include a supersonic compression rotor that is positioned in flow communication between a fluid inlet and a centrifugal compressor assembly to compress fluid and channel the compressed fluid to the centrifugal compressor assembly. In addition, by providing a supersonic compressor rotor upstream of the centrifugal compressor assembly, the supersonic compressor system is able to compress a higher volume of fluid than known centrifugal compressor assemblies.

Figure 2:
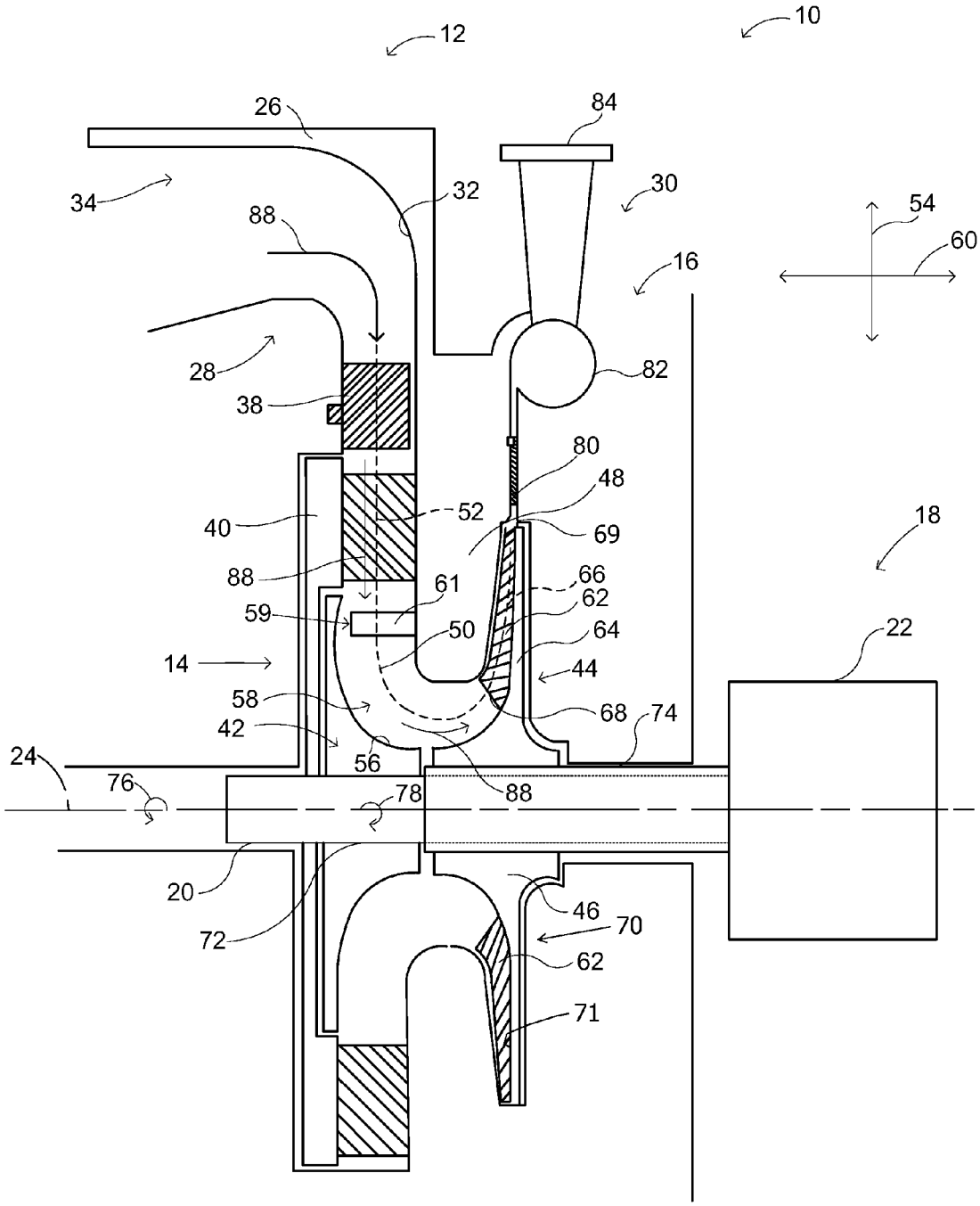
FIG. 2 is a schematic cross-sectional view of the supersonic compressor system shown in FIG. 1.

FIG. 1 is a schematic view of an exemplary supersonic compressor system 10. FIG. 2 is a schematic cross-sectional view of supersonic compressor system 10. Identical components shown in FIG. 2 are labeled with the same reference numbers used in FIG. 1. In the exemplary embodiment, supersonic compressor system 10 includes an intake section 12, a compressor section 14 coupled downstream from intake section 12, a discharge section 16 coupled downstream from compressor section 14, and a drive assembly 18. Drive assembly 18 includes at least one drive shaft 20 that is rotatably coupled to a drive motor 22. Drive shaft 20 defines a centerline axis 24 and is coupled to compressor section 14 for rotating compressor section 14 about centerline axis 24. In the exemplary embodiment, each of intake section 12, compressor section 14, and discharge section 16 are positioned within a compressor housing 26. Compressor housing 26 includes a fluid inlet 28, a fluid outlet 30, and an inner surface 32 that defines a cavity 34. Cavity 34 extends between fluid inlet 28 and fluid outlet 30 and is configured to channel a fluid from fluid inlet 28 to fluid outlet 30. Each of intake section 12, compressor section 14, and discharge section 16 are positioned within cavity 34.

In the exemplary embodiment, fluid inlet 28 is configured to channel fluid from a fluid source 36 to intake section 12. The fluid may be any fluid such as, for example a gas, a gas mixture, a solid-gas mixture, and/or a liquid-gas mixture. Intake section 12 is positioned in flow communication between compressor section 14 and fluid inlet 28 for channeling fluid from fluid inlet 28 to compressor section 14. Discharge section 16 is positioned in flow communication between compressor section 14 and fluid outlet 30.

In the exemplary embodiment, intake section 12 includes one or more inlet guide vane assemblies 38. Inlet guide vane assembly 38 is configured to condition a fluid to include one or more predetermined parameters, such as a swirl, a velocity, a mass flow rate, a pressure, a temperature, and/or any suitable flow parameter to enable compressor section 14 to function as described herein. Inlet guide vane assembly 38 is coupled between fluid inlet 28 and compressor section 14 for channeling fluid from fluid inlet 28 to compressor section 14.

In the exemplary embodiment, compressor section 14 is coupled between intake section 12 and discharge section 16 for channeling at least a portion of fluid from intake section 12 to discharge section 16. Compressor section 14 includes at least one supersonic compressor rotor 40, a transition assembly 42, and a compressor assembly 44. Supersonic compressor rotor 40 is positioned in flow communication between inlet guide vane assembly 38 and compressor assembly 44. Compressor assembly 44 includes a centrifugal compressor assembly 46. In the exemplary embodiment, compressor housing 26 includes a diaphragm assembly 48 positioned adjacent supersonic compressor rotor 40, transition assembly 42, and centrifugal compressor assembly 46. Diaphragm assembly 48 at least partially defines a flow path, represented by arrow 50, through supersonic compressor system 10.

In the exemplary embodiment, supersonic compressor rotor 40 is configured to increase a pressure of fluid, reduce a volume of fluid, and/or increase a temperature of fluid being channeled from intake section 12 to discharge section 16. Supersonic compressor rotor 40 channels fluid from inlet guide vane assembly 38 to transition assembly 42. In the exemplary embodiment, supersonic compressor rotor 40 includes a radial flow path 52 that channels fluid along a radial direction 54 that is substantially perpendicular to centerline axis 24. Transition assembly 42 is configured to channel fluid from supersonic compressor rotor 40 to centrifugal compressor assembly 46. Transition assembly 42 includes an inner surface 56 that defines a transition flow channel 58 that extends between supersonic compressor rotor 40 and centrifugal compressor assembly 46. Transition flow channel 58 is sized, shaped, and oriented to transition an orientation of fluid from radial direction 54 to an axial direction 60 that is substantially parallel to centerline axis 24. In one embodiment, transition assembly 42 includes one or more rows 59 of circumferentially-spaced stationary blades 61 that are configured to condition fluid being channeled to centrifugal compressor assembly 46.

In the exemplary embodiment, centrifugal compressor assembly 46 is positioned in flow communication between transition assembly 42 and discharge section 16. Centrifugal compressor assembly 46 includes a plurality of centrifugal vanes 62 that are coupled to a compressor disk 64. Adjacent centrifugal vanes 62 are spaced circumferentially about compressor disk 64 to define a centrifugal flow channel 66 that extends between each adjacent centrifugal vane 62. Centrifugal flow channel 66 extends between a flow channel inlet 68 and a flow channel outlet 69. Flow channel inlet 68 is positioned adjacent supersonic compressor rotor 40 and is configured to receive fluid from supersonic compressor rotor 40 along axial direction 60. Flow channel outlet 69 is positioned adjacent discharge section 16 and is configured to discharge fluid in radial direction 54 to discharge section 16. Centrifugal flow channel 66 is sized, shaped, and oriented to channel fluid from axial direction 60 to radial direction 54, and to impart a centrifugal force to fluid to increase a pressure and a velocity of fluid discharged through flow channel outlet 69.

In an alternative embodiment, compressor assembly 44 includes a mixed-flow compressor assembly 70. Mixed-flow compressor assembly 70 includes at least one inner surface 71 that is oriented obliquely with respect to axial direction 60 and/or radial direction 54. In one embodiment, mixed flow compressor assembly 70 is configured to receive fluid from supersonic compressor rotor 40 at an angle that is oblique to axial direction 60. Mixed-flow compressor assembly 70 is also configured to discharge fluid in a direction that is oblique to radial direction 54.

In the exemplary embodiment, drive assembly 18 includes a first drive shaft 72. Each supersonic compressor rotor 40, transition assembly 42, and centrifugal compressor assembly 46 are coupled to first drive shaft 72. Drive assembly 18 is configured to rotate first drive shaft 72 such that each supersonic compressor rotor 40, transition assembly 42, and centrifugal compressor assembly 46 rotate at a same rotational velocity. In an alternative embodiment, drive assembly 18 includes a second drive shaft 74 coupled to drive motor 22. In this alternative embodiment, first drive shaft 72 is coupled to supersonic compressor rotor 40. Second drive shaft 74 is coupled to compressor assembly 44. Drive assembly 18 is configured to rotate supersonic compressor rotor 40 in a first rotational direction, represented by arrow 76, and to rotate compressor assembly 44 in a second rotational direction, represented by arrow 78, that is opposite first rotational direction 76. Moreover, drive assembly 18 may be configured to rotate supersonic compressor rotor 40 at a first rotational velocity, and to rotate compressor assembly 44 at a second rotational velocity that is different than the first rotational velocity. In one embodiment, first drive shaft 72 is positioned within second drive shaft 74 and is oriented concentrically with respect to second drive shaft 74.

In the exemplary embodiment, discharge section 16 includes a vane diffuser 80 and a discharge scroll 82. Vane diffuser 80 is positioned in flow communication between compressor assembly 44 and discharge scroll 82, and is configured to impart a swirl to fluid being discharged from compressor assembly 44. Discharge scroll 82 is configured to condition fluid to include one or more predetermined parameters, such as a velocity, a mass flow rate, a temperature, and/or any suitable flow parameter. Discharge scroll 82 is also configured to channel fluid from compressor assembly 44 to fluid outlet 30. Fluid outlet 30 includes a discharge flange 84 and is configured to channel fluid from discharge scroll 82 to an output system 86 such as, for example, a turbine engine system, a fluid treatment system, and/or a fluid storage system.

During operation, inlet guide vane assembly 38 channels a fluid 88 from fluid inlet 28 to supersonic compressor rotor 40. Inlet guide vane assembly 38 increases a velocity of fluid 88, and imparts a swirl to fluid 88 being channeled to supersonic compressor rotor 40. Supersonic compressor rotor 40 receives fluid 88 from inlet guide vane assembly 38, reduces a volume of fluid 88, and increases a pressure in fluid 88 prior to discharging fluid 88 into transition assembly 42. Transition assembly 42 turns fluid 88 from radial direction 54 to axial direction 60 and channels fluid 88 into centrifugal compressor assembly 46. Centrifugal compressor assembly 46 receives fluid 88 along axial direction 60 and imparts a centrifugal force to fluid 88 that causes an increase in a pressure of fluid 88, and discharges fluid 88 along radial direction 54 to vane diffuser 80. In one embodiment, transition assembly 42 turns fluid 88 from a direction that is oblique to radial direction 54 to discharge fluid in a direction that is oblique to axial direction 60.

Figure 3:
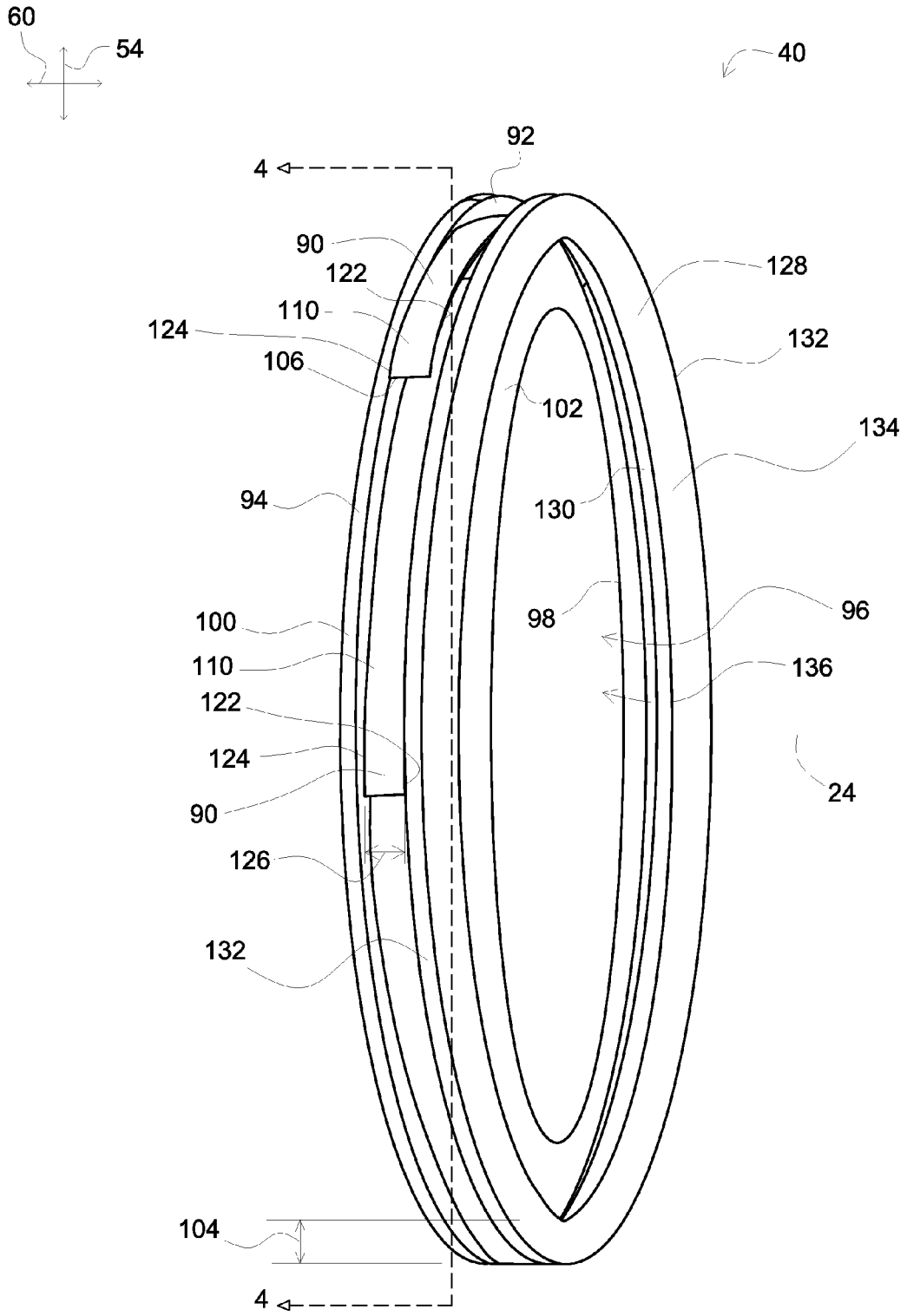
FIG. 3 is a perspective view of an exemplary supersonic compressor rotor that may be used with the supersonic compressor system shown in FIG. 2.
Figure 4:
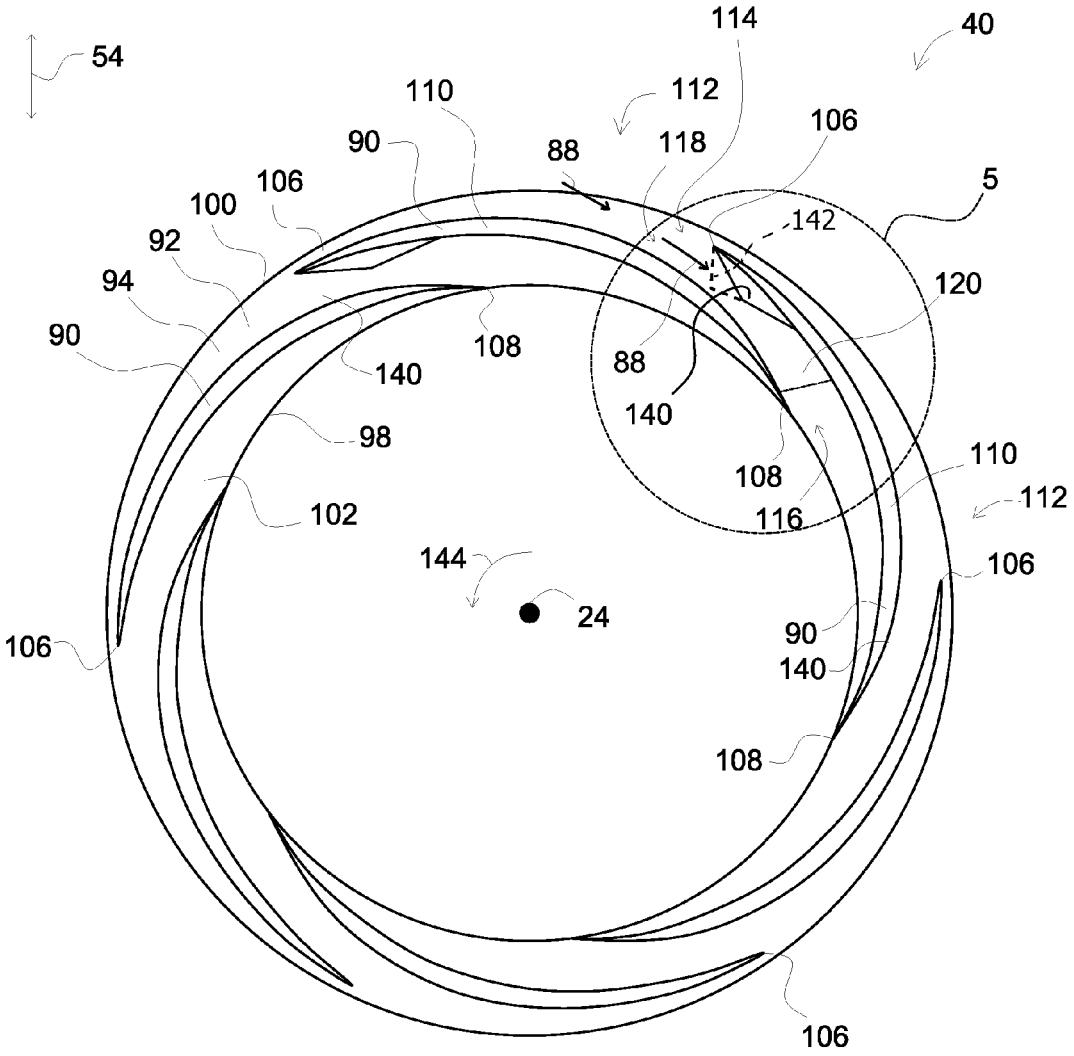
FIG. 4 is a cross-sectional view of the supersonic compressor rotor shown in FIG. 3 taken along line 4-4 in FIG. 3.
Figure 5:
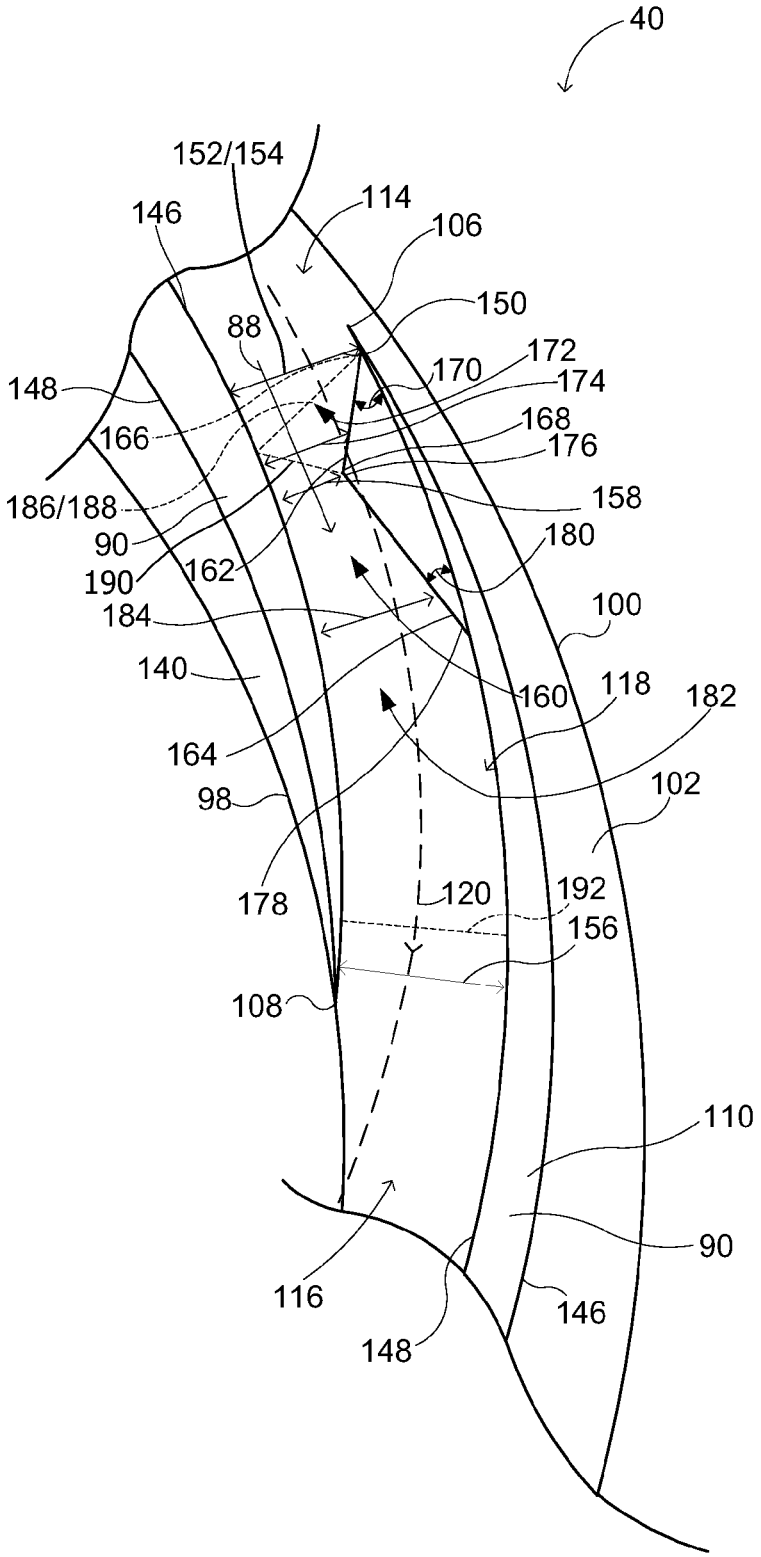
FIG. 5 is an enlarged cross-sectional view of a portion of the supersonic compressor rotor shown in FIG. 3 and taken along area 5.

FIG. 3 is a perspective view of an exemplary supersonic compressor rotor 40. FIG. 4 is a cross-sectional view of supersonic compressor rotor 40 at sectional line 4-4 shown in FIG. 3. FIG. 5 is an enlarged cross-sectional view of a portion of supersonic compressor rotor 40 taken along area 5 shown in FIG. 4. Identical components shown in FIG. 4 and FIG. 5 are labeled with the same reference numbers used in FIG. 3. In the exemplary embodiment, supersonic compressor rotor 40 includes a plurality of vanes 90 that are coupled to a rotor disk 92. Rotor disk 92 includes an annular disk body 94 that defines an inner cylindrical cavity 96 extending generally axially through disk body 94 along centerline axis 24. Disk body 94 includes a radially inner surface 98, a radially outer surface 100, and an endwall 102 that extends generally radially between radially inner surface 98 and radially outer surface 100. Endwall 102 extends in a radial direction 54 that is oriented perpendicular to centerline axis 24, and includes a width 104 defined between radially inner surface 98 and radially outer surface 100. Radially inner surface 98 defines inner cylindrical cavity 96. Inner cylindrical cavity 96 has a substantially cylindrical shape and is oriented about centerline axis 24. Inner cylindrical cavity 96 is sized to receive drive shaft 20 (shown in FIG. 1) therethrough.

In the exemplary embodiment, each vane 90 is coupled to endwall 102 and extends outwardly from endwall 102 in an axial direction 60 that is generally parallel to centerline axis 24. Each vane 90 includes an inlet edge 106 and an outlet edge 108. Inlet edge 106 is positioned adjacent radially outer surface 100. Outlet edge 108 is positioned adjacent radially inner surface 98. In the exemplary embodiment, adjacent vanes 90 form a pair 112 of vanes 90. Each pair 112 is oriented to define an inlet opening 114, an outlet opening 116, and a flow channel 118 between adjacent vanes 90. Flow channel 118 extends between inlet opening 114 and outlet opening 116 and defines a flow path, represented by arrow 120, (shown in FIG. 4 and FIG. 5) that extends from inlet opening 114 to outlet opening 116. Flow path 120 is oriented generally parallel to vane 90. Flow channel 118 is sized, shaped, and oriented to channel fluid along flow path 120 from inlet opening 114 to outlet opening 116 in radial direction 54. Inlet opening 114 is defined between adjacent inlet edges 106 of adjacent vanes 90. Outlet opening 116 is defined between adjacent outlet edges 108 of adjacent vanes 90. Vane 90 extends radially between inlet edge 106 and outlet edge 108 such that vane 90 extends between radially inner surface 98 and radially outer surface 100. Vane 90 includes an outer surface 122 and an opposite inner surface 124. Inner surface 124 is coupled to endwall 102. Vane 90 extends between outer surface 122 and inner surface 124 to define an axial height 126 of flow channel 118.

Referring to FIG. 3, in the exemplary embodiment, a shroud assembly 128 is coupled to outer surface 122 of each vane 90 such that flow channel 118 (shown in FIG. 4) is defined between shroud assembly 128 and endwall 102. Shroud assembly 128 includes an inner edge 130, an outer edge 132, and a shroud plate 134 that extends between inner edge 130 and outer edge 132. Inner edge 130 defines a substantially cylindrical opening 136. Shroud assembly 128 is oriented coaxially with rotor disk 92, such that inner cylindrical cavity 96 is concentric with opening 136. Shroud plate 134 is coupled to each vane 90 such that inlet edge 106 of vane 90 is positioned adjacent inner edge 130 of shroud assembly 128, and outlet edge 108 of vane 90 is positioned adjacent outer edge 132 of shroud assembly 128. In an alternative embodiment, supersonic compressor rotor 40 does not include shroud assembly 128. In such an embodiment, diaphragm assembly 48 is positioned adjacent each outer surface 122 of vanes 90 such that diaphragm assembly 48 at least partially defines flow channel 118.

Referring to FIG. 4, in the exemplary embodiment, at least one supersonic compression ramp 140 is positioned within flow channel 118. Supersonic compression ramp 140 is positioned between inlet opening 114 and outlet opening 116, and is sized, shaped, and oriented to enable one or more compression waves 142 to form within flow channel 118.

During operation of supersonic compressor rotor 40, inlet guide vane assembly 38 (shown in FIG. 2) channels a fluid 88 towards inlet opening 114 of flow channel 118. Fluid 88 has a first velocity, i.e. an approach velocity, just prior to entering inlet opening 114. Supersonic compressor rotor 40 is rotated about centerline axis 24 at a second velocity, i.e. a rotational velocity, represented by arrow 144, such that fluid 88 entering flow channel 118 has a third velocity, i.e. an inlet velocity at inlet opening 114 that is supersonic relative to vanes 90. As fluid 88 is channeled through flow channel 118 at a supersonic velocity, supersonic compression ramp 140 causes compression waves 142 to form within flow channel 118 to facilitate compressing fluid 88, such that fluid 88 includes an increased pressure and temperature, and/or includes a reduced volume at outlet opening 116.

Referring to FIG. 5, in the exemplary embodiment, each vane 90 includes a first, or suction side 146 and an opposing second, or pressure side 148. Each suction side 146 and pressure side 148 extends between inlet edge 106 and outlet edge 108. Each vane 90 is spaced circumferentially about inner cylindrical cavity 96 such that flow channel 118 is oriented generally radially between inlet opening 114 and outlet opening 116. Each inlet opening 114 extends between a suction side 146 and an adjacent pressure side 148 of vane 90 at inlet edge 106. Each outlet opening 116 extends between suction side 146 and an adjacent pressure side 148 at outlet edge 108, such that flow path 120 is defined radially inwardly from radially outer surface 100 to radially inner surface 98. In the exemplary embodiment, flow channel 118 includes a width 150 that is defined between suction side 146 and adjacent pressure side 148, and is perpendicular to flow path 120. In the exemplary embodiment, each vane 90 is formed with an arcuate shape and is oriented such that flow channel 118 is defined with a spiral shape.

In the exemplary embodiment, flow channel 118 defines a cross-sectional area 152 that varies along flow path 120. Cross-sectional area 152 of flow channel 118 is defined perpendicularly to flow path 120 and is equal to width 150 of flow channel 118 multiplied by axial height 126 (shown in FIG. 3) of flow channel 118. Flow channel 118 includes a first area, i.e. an inlet cross-sectional area 154 at inlet opening 114, a second area, i.e. an outlet cross-sectional area 156 at outlet opening 116, and a third area, i.e. a minimum cross-sectional area 158 that is defined between inlet opening 114 and outlet opening 116. In the exemplary embodiment, minimum cross-sectional area 158 is less than inlet cross-sectional area 154 and outlet cross-sectional area 156.

In the exemplary embodiment, supersonic compression ramp 140 is coupled to pressure side 148 of vane 90 and defines a throat region 160 of flow channel 118. Throat region 160 defines minimum cross-sectional area 158 of flow channel 118. In an alternative embodiment, supersonic compression ramp 140 may be coupled to suction side 146 of vane 90, endwall 102, and/or shroud assembly 128. In a further alternative embodiment, supersonic compressor rotor 40 includes a plurality of supersonic compression ramps 140 that are each coupled to suction side 146, pressure side 148, endwall 102, and/or shroud assembly 128. In such an embodiment, each supersonic compression ramp 140 collectively defines throat region 160.

In the exemplary embodiment, supersonic compression ramp 140 includes a compression surface 162 and a diverging surface 164. Compression surface 162 includes a first edge, i.e. a leading edge 166 and a second edge, i.e. a trailing edge 168. Leading edge 166 is positioned closer to inlet opening 114 than trailing edge 168. Compression surface 162 extends between leading edge 166 and trailing edge 168 and is oriented at an oblique angle 170 from vane 90 towards adjacent suction side 146 and into flow path 120. Compression surface 162 converges towards adjacent suction side 146 such that a compression region 172 is defined between leading edge 166 and trailing edge 168. Compression region 172 includes a converging cross-sectional area 174 of flow channel 118 that is reduced along flow path 120 from leading edge 166 to trailing edge 168. Trailing edge 168 of compression surface 162 defines throat region 160.

Diverging surface 164 is coupled to compression surface 162 and extends downstream from compression surface 162 towards outlet opening 116. Diverging surface 164 includes a first end 176 and a second end 178 that is positioned closer to outlet opening 116 than first end 176. First end 176 of diverging surface 164 is coupled to trailing edge 168 of compression surface 162. Diverging surface 164 extends between first end 176 and second end 178 and is oriented at an oblique angle 180 from pressure side 148 towards adjacent suction side 146. Diverging surface 164 defines a diverging region 182 that includes a diverging cross-sectional area 184 that increases from trailing edge 168 of compression surface 162 to outlet opening 116. Diverging region 182 extends from throat region 160 to outlet opening 116.

In the exemplary embodiment, supersonic compression ramp 140 is sized, shaped, and oriented to cause a system 186 of compression waves 142 to be formed within flow channel 118. During operation, as fluid 88 contacts leading edge 166 of supersonic compression ramp 140, a first oblique shock wave 188 of system 186 is formed. Compression region 172 of supersonic compression ramp 140 is configured to cause first oblique shock wave 188 to be oriented at an oblique angle with respect to flow path 120 from leading edge 166 towards adjacent vane 90, and into flow channel 118. As first oblique shock wave 188 contacts adjacent vane 90, a second oblique shock wave 190 is reflected from adjacent vane 90 at an oblique angle with respect to flow path 120, and towards throat region 160 of supersonic compression ramp 140. Supersonic compression ramp 140 is configured to cause each first oblique shock wave 188 and second oblique shock wave 190 to form within compression region 172. As fluid passes through throat region 160 towards outlet opening 116, a normal shock wave 192 is formed within diverging region 182. Normal shock wave 192 is oriented perpendicular to flow path 120 and extends across flow path 120.

As fluid 88 passes through compression region 172, a velocity of fluid 88 is reduced as fluid 88 passes through each first oblique shock wave 188 and second oblique shock wave 190. In addition, a pressure of fluid 88 is increased, and a volume of fluid 88 is decreased. As fluid 88 passes through throat region 160, a velocity of fluid 88 is increased downstream of throat region 160 towards normal shock wave 192. As fluid passes through normal shock wave 192, a velocity of fluid 88 is decreased to a subsonic velocity with respect to rotor disk 92.

In an alternative embodiment, supersonic compression ramp 140 is configured to condition fluid 88 to have an outlet velocity at outlet opening 116 that is supersonic with respect to rotor disk 92. Supersonic compression ramp 140 is further configured to prevent a normal shock wave from being formed downstream of throat region 160 and within flow channel 118.

Figure 6:
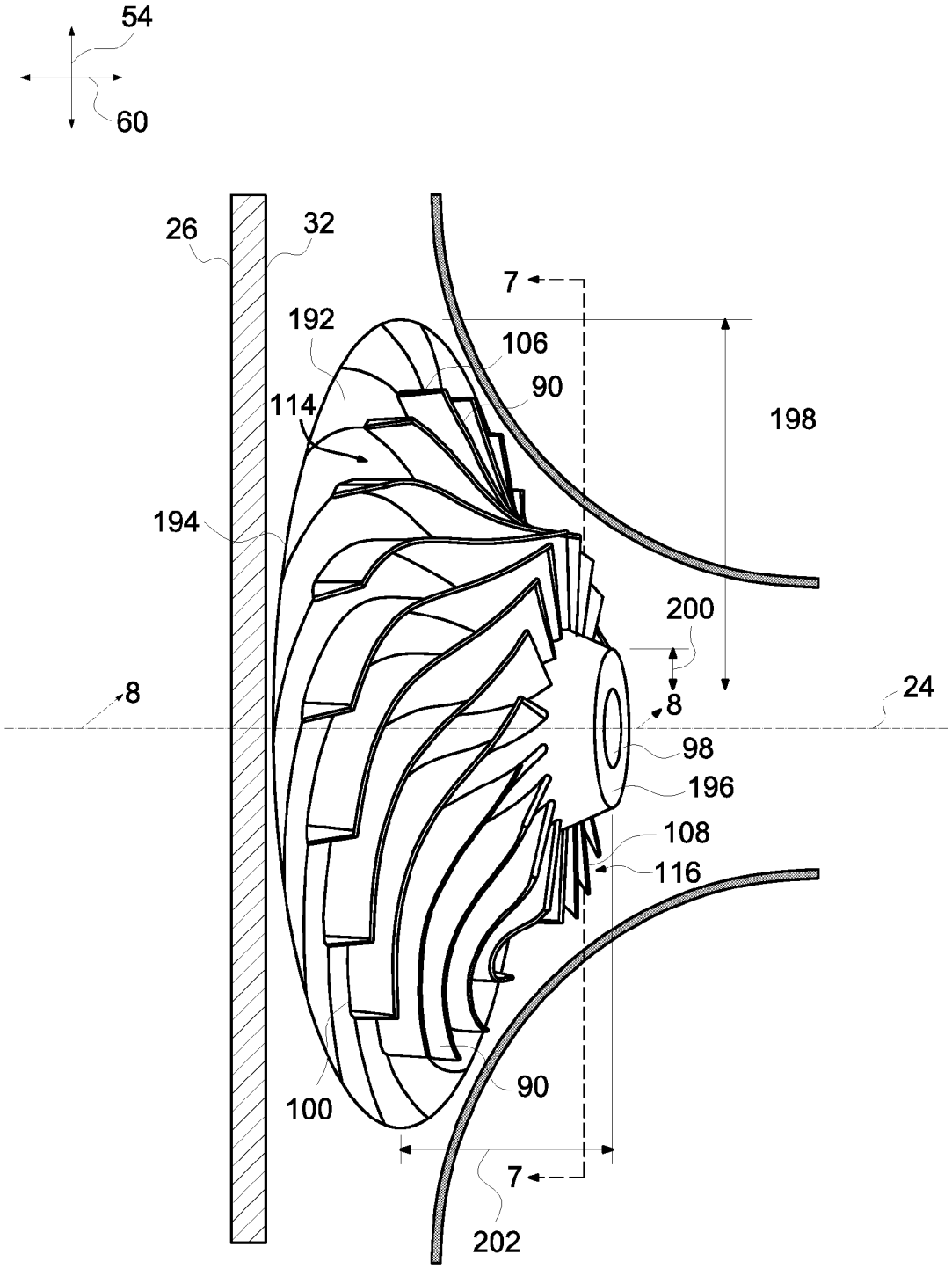
FIG. 6 is a perspective view of an alternative supersonic compressor rotor that may be used with the supersonic compressor system shown in FIG. 2.
Figure 7:
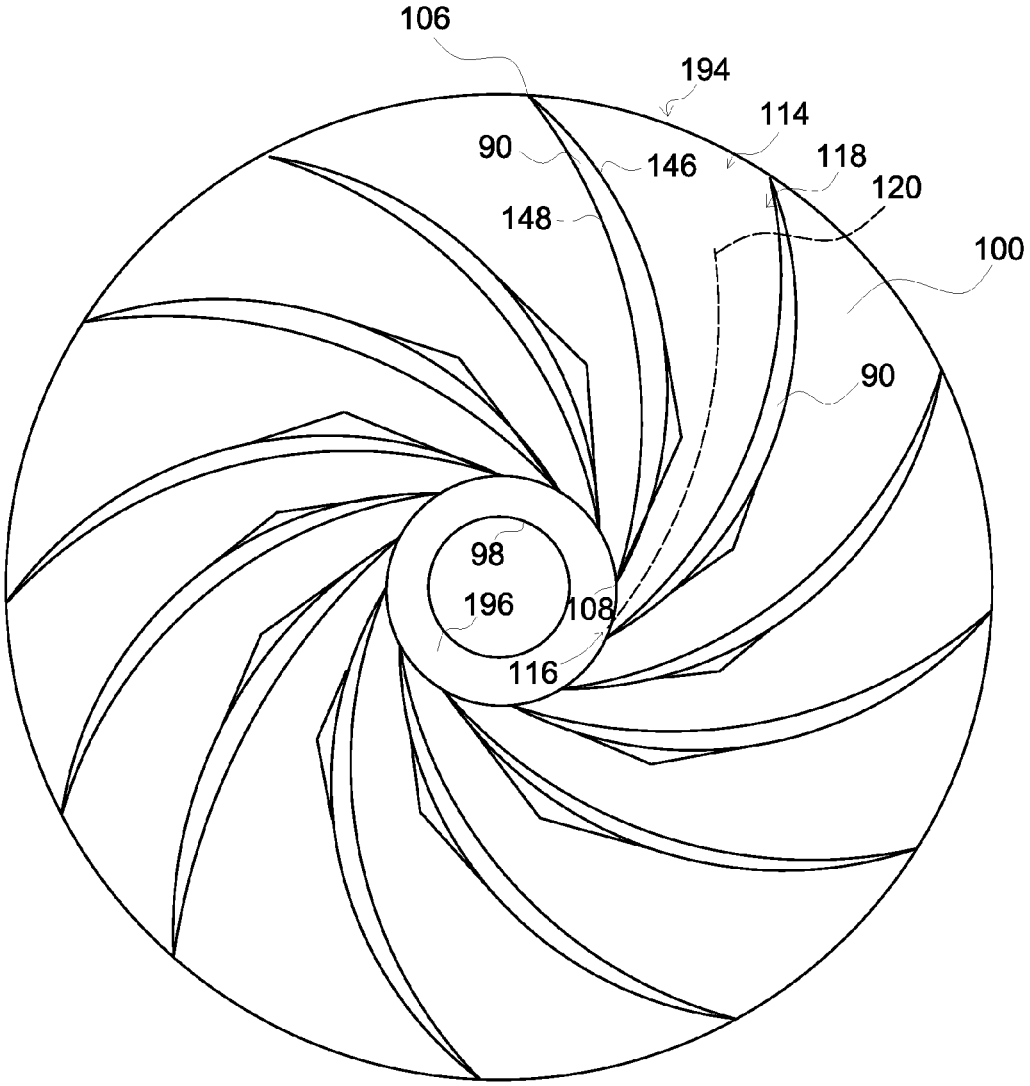
FIG. 7 is a cross-sectional view of the supersonic compressor rotor shown in FIG. 6 taken along line 7-7 in FIG. 6.
Figure 8:
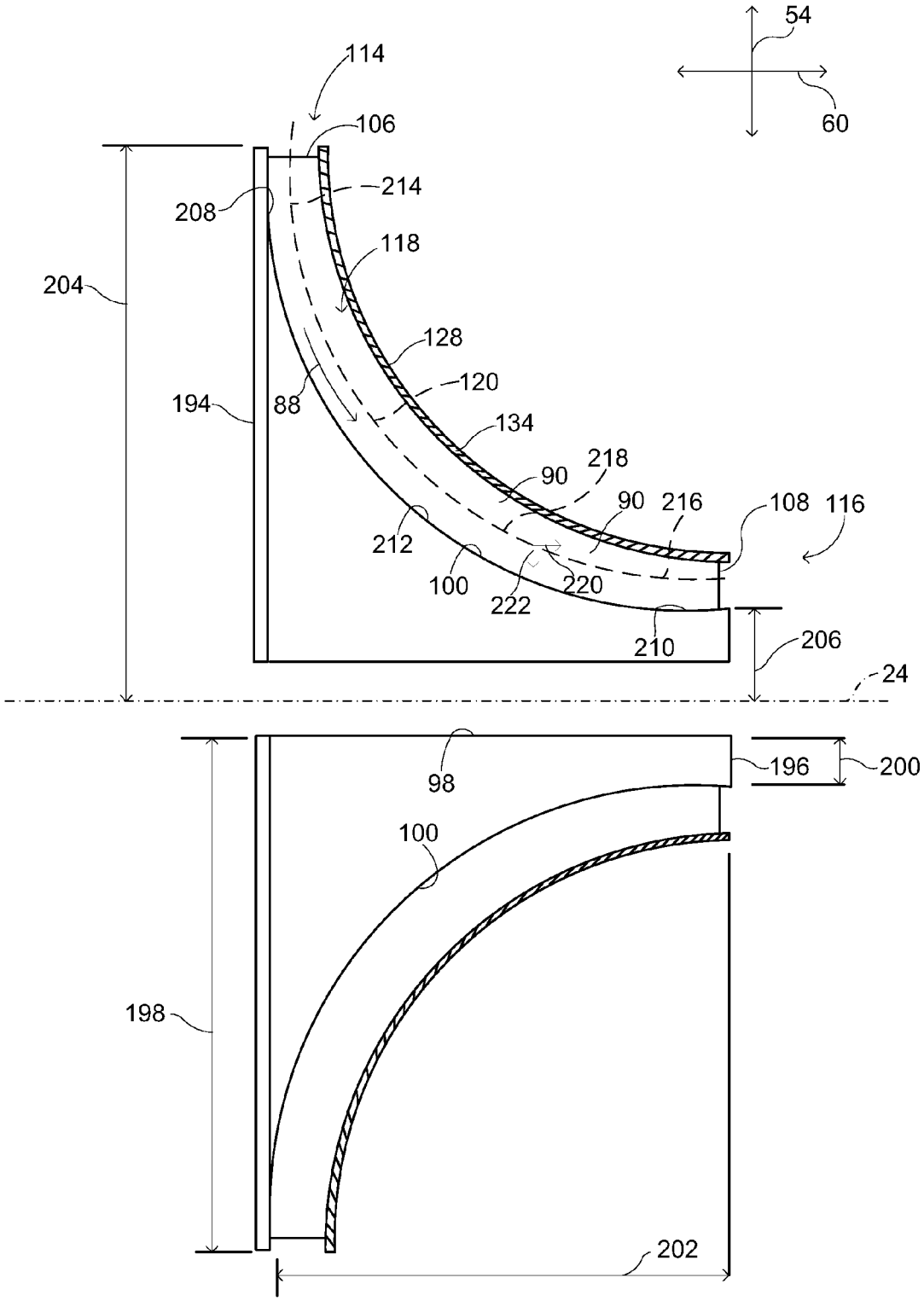
FIG. 8 is another cross-sectional view of the supersonic compressor rotor shown in FIG. 6 taken along line 8-8 in FIG. 6.

FIG. 6 is a perspective view of an alternative embodiment of supersonic compressor rotor 40. FIG. 7 is a cross-sectional view of supersonic compressor rotor 40 taken along sectional line 7-7 shown in FIG. 6. FIG. 8 is a cross-sectional view of supersonic compressor rotor 40 taken along section line 8-8 shown in FIG. 6. Identical components shown in FIGS. 6-8 are labeled with the same reference numbers used in FIG. 3. In an alternative embodiment, rotor disk 92 includes an upstream surface 194 and a downstream surface 196. Each upstream surface 194 and downstream surface 196 extends between radially inner surface 98 and radially outer surface 100 in radial direction 54. Upstream surface 194 includes a first radial width 198 that is defined between radially inner surface 98 and radially outer surface 100. Downstream surface 196 includes a second radial width 200 that is defined between radially inner surface 98 and radially outer surface 100. First radial width 198 is larger than second radial width 200.

In this alternative embodiment, radially outer surface 100 is coupled between upstream surface 194 and downstream surface 196, and extends a distance 202 defined from upstream surface 194 to downstream surface 196 in axial direction 60. Each vane 90 is coupled to radially outer surface 100 and extends outwardly from radially outer surface 100. Inlet edge 106 of each vane 90 is positioned adjacent upstream surface 194 of rotor disk 92. Outlet edge 108 of each vane 90 is positioned adjacent downstream surface 196. Each inlet opening 114 is defined by radially outer surface 100 and is adjacent upstream surface 194. Each outlet opening 116 is defined by radially outer surface 100 and is adjacent downstream surface 196. Inlet opening 114 is positioned a first radial distance 204 from centerline axis 24. Outlet opening 116 is positioned a second radial distance 206 from centerline axis 24 that is greater than first radial distance 204.

Referring to FIG. 8, radially outer surface 100 includes an inlet surface 208, an outlet surface 210, and a transition surface 212 that extends between inlet surface 208 and outlet surface 210. Inlet surface 208 extends from upstream surface 194 to transition surface 212. Outlet surface 210 extends from transition surface 212 to downstream surface 196. Inlet surface 208 is oriented substantially perpendicular to centerline axis 24 such that flow channel 118 defines a radial flow path 214 that extends along radial direction 54. Radial flow path 214 extends from inlet opening 114 to transition surface 212 and channels fluid in radial direction 54. Outlet surface 210 is oriented substantially parallel to centerline axis 24 such that flow channel 118 defines an axial flow path 216 that extends along axial direction 60. Axial flow path 216 extends from transition surface 212 to outlet opening 116 and channels fluid in axial direction 60. Transition surface 212 is formed with an arcuate shape and defines a transition flow path 218 that extends between inlet surface 208 to outlet surface 210. Transition surface 212 is oriented to channel fluid from radial direction 54 to axial direction 60 such that fluid is characterized by having an axial flow vector, represented by arrow 220, and a radial flow vector, represented by arrow 222 through transition flow path 218.

In this alternative embodiment, during operation fluid 88 enters inlet opening 114 and is channeled through radial flow path 214 along radial direction 54. As fluid enters transition flow path 218, flow channel 118 channels fluid from radial direction 54 to axial direction 60 and channels fluid from radial flow path 214 to axial flow path 216. Fluid 88 is then discharged from axial flow path 216 through outlet opening 116 in axial direction 60.

Figure 9:
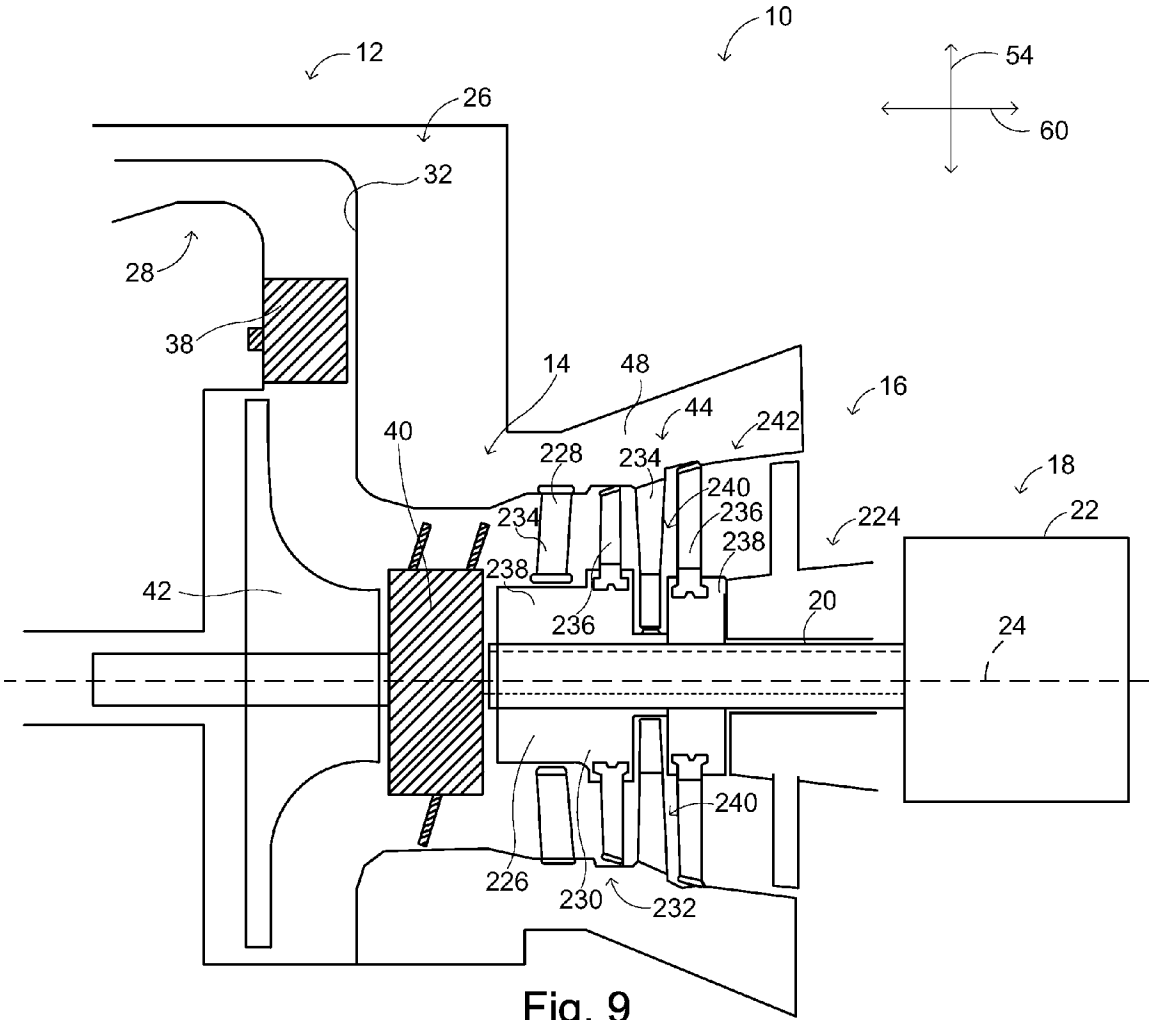
FIG. 9 is a schematic cross-sectional view of an alternative supersonic compressor system.
Figure 10:
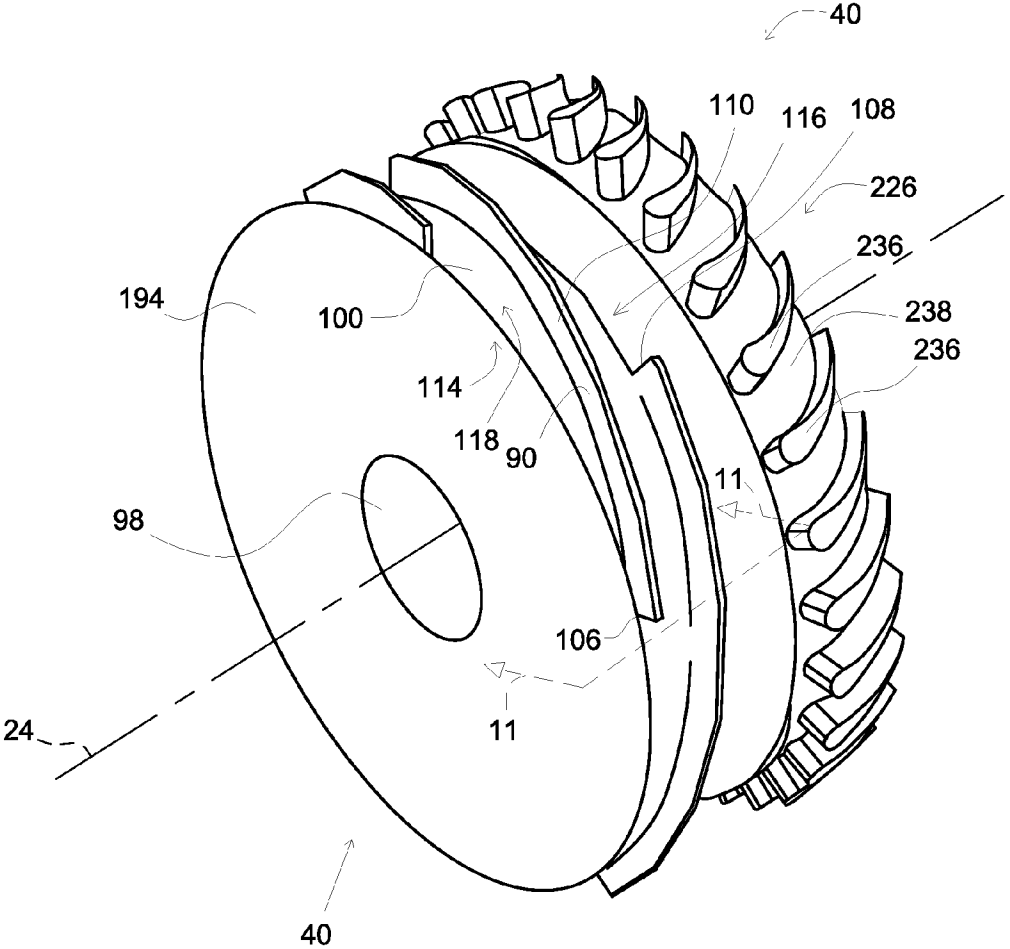
FIG. 10 is a perspective view of an alternative supersonic compressor rotor that may be used with the supersonic compressor system shown in FIG. 9.
Figure 11:
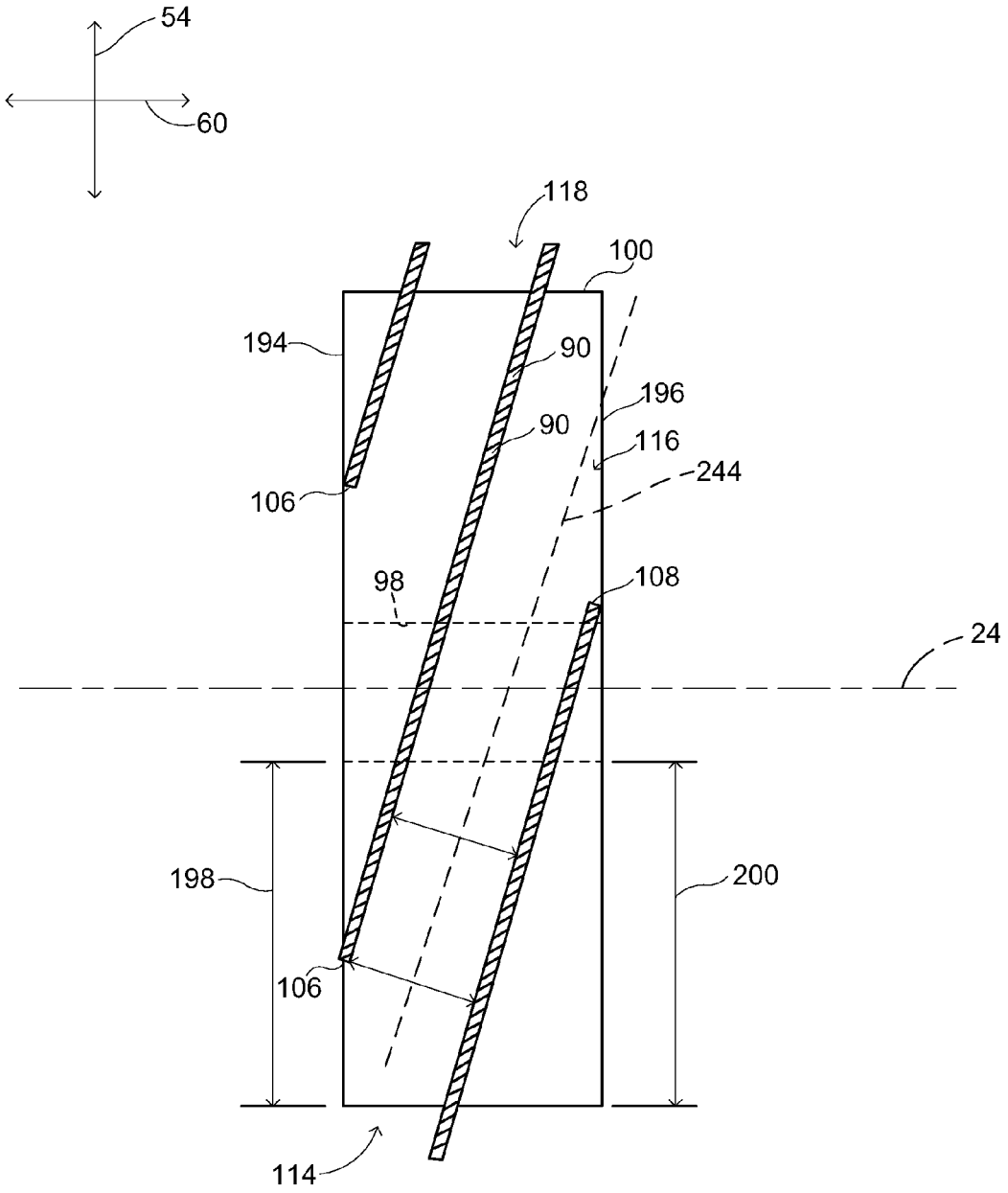
FIG. 11 is a sectional view of the supersonic compressor rotor shown in FIG. 9 taken along line 11-11 in FIG. 10.

FIG. 9 is a schematic cross-sectional view of an alternative embodiment of supersonic compressor system 10. FIG. 10 is a perspective view of an alternative embodiment of supersonic compressor rotor 40. FIG. 11 is a sectional view of supersonic compressor rotor 40 shown in FIG. 10 taken along sectional line 11-11. Identical components shown in FIG. 9 are labeled with the same reference numbers used in FIG. 2. Identical components shown in FIG. 10 and FIG. 11 are labeled with the same reference numbers used in FIG. 3 and FIG. 7. In an alternative embodiment, supersonic compressor rotor 40 is positioned in flow communication between transition assembly 42 and compressor assembly 44. Discharge section 16 includes an outlet guide vane assembly 224 that is rotatably coupled to drive shaft 20 and is positioned in flow communication between compressor assembly 44 and fluid outlet 30. Compressor assembly 44 includes an axial compressor assembly 226, and is positioned in flow communication between supersonic compressor rotor 40 and outlet guide vane assembly 224. Axial compressor assembly 226 includes one or more stationary stator vane assemblies 228 and one or more compressor disk assemblies 230. Each compressor disk assembly 230 is spaced axially and between each adjacent pair 232 of stator vane assemblies 228. Each stator vane assembly 228 is coupled to diaphragm assembly 48 and includes a plurality of circumferentially-spaced stators 234 that extend from diaphragm assembly 48 toward drive shaft 20. Each compressor disk assembly 230 includes a plurality of compressor blades 236 that are each coupled to a compressor disk 238. Each compressor blade 236 is circumferentially-spaced about compressor disk 238 and extends radially outwardly from compressor disk 238 towards diaphragm assembly 48. Adjacent compressor disks 238 are coupled together such that a gap 240 is defined between each adjacent row 242 of circumferentially-spaced compressor blades 236. Stators 234 are spaced circumferentially about each compressor disk 238 between adjacent rows 242 of compressor blades 236.

In an alternative embodiment, supersonic compressor rotor 40 includes a first radial width 198 of upstream surface 194 that is equal to second radial width 200 of downstream surface 196. Each vane 90 is coupled to radially outer surface 100 and extends circumferentially about rotor disk 92 in a helical shape. Vane 90 of each vane 90 extends outwardly from radially outer surface 100 in radial direction 54. Each vane 90 is spaced axially from an adjacent vane 90 such that flow channel 118 is oriented generally in axial direction 60 between inlet opening 114 and outlet opening 116. Flow channel 118 defines an axial flow path 244 along axial direction 60 from inlet opening 114 to outlet opening 116.

During operation, in an alternative embodiment, inlet guide vane assembly 38 channels fluid 88 in radial direction 54 to transition assembly 42. Transition assembly 42 channels fluid 88 from radial direction 54 to axial direction 60. Supersonic compressor rotor 40 compresses fluid 88 in axial direction 60 and discharges fluid 88 axially toward axial compressor assembly 226. Axial compressor assembly 226 further compresses fluid 88 and discharges fluid 88 to outlet guide vane assembly 224 in axial direction 60.

The above-described supersonic compressor rotor provides a cost effective and reliable method for compressing a fluid through a supersonic compressor system. More specifically, the supersonic compressor system described herein includes a supersonic compressor rotor that is positioned in flow communication between a fluid inlet and a centrifugal compressor assembly to compress fluid and channel the compressed fluid to the centrifugal compressor assembly. Moreover, by providing a supersonic compressor rotor upstream of the centrifugal compressor assembly, the supersonic compressor system is able to compress a higher volume of fluid than known supersonic compressor assemblies. As a result, the cost of operating a supersonic compressor system to compress a fluid may be reduced.

Exemplary embodiments of systems and methods for assembling a supersonic compressor rotor are described above in detail. The system and methods are not limited to the specific embodiments described herein, but rather, components of systems and/or steps of the method may be utilized independently and separately from other components and/or steps described herein. For example, the systems and methods may also be used in combination with other rotary engine systems and methods, and are not limited to practice with only the supersonic compressor system as described herein. Rather, the exemplary embodiment can be implemented and utilized in connection with many other rotary system applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A supersonic compressor system comprising:

a casing defining a cavity extending between a fluid inlet and a fluid outlet;

a first drive shaft positioned within said cavity, wherein a centerline axis extends along a centerline of said first drive shaft;

a supersonic compressor rotor coupled to said first drive shaft and positioned in flow communication between said fluid inlet and said fluid outlet, said supersonic compressor rotor comprising a radially outer surface and a plurality of vanes, adjacent said vanes and said radially outer surface defining a flow channel, said flow channel having disposed within it at least one supersonic compression ramp configured to form at least one compression wave for compressing a fluid within said flow channel; and a centrifugal compressor assembly positioned in flow communication between said supersonic compressor rotor and said fluid outlet, said centrifugal compressor assembly configured to compress fluid received from said supersonic compressor rotor.

2. A supersonic compressor system in accordance with claim 1, further comprising an inlet guide vane assembly positioned in flow communication between said fluid inlet and said supersonic compressor rotor.

3. A supersonic compressor system in accordance with claim 1, wherein said centrifugal compressor assembly is coupled to said first drive shaft, said first drive shaft configured to rotate each of said supersonic compressor rotor and said centrifugal compressor assembly at a first rotational velocity.

4. A supersonic compressor system in accordance with claim 1, further comprising a second drive shaft coupled to said centrifugal compressor assembly, wherein said first drive shaft is configured to rotate said supersonic compressor rotor at a first rotational velocity, and said second drive shaft is configured to rotate said centrifugal compressor assembly at a second rotational velocity that is different than the first rotational velocity.

5. A supersonic compressor system in accordance with claim 4, wherein said first drive shaft is configured to rotate said supersonic compressor rotor in a first rotational direction, and said second drive shaft is configured to rotate said centrifugal compressor assembly in a second rotational direction that is different than the first rotational direction.

6. A supersonic compressor system in accordance with claim 1, wherein:

the radially outer surface of the rotor extends generally between an upstream surface and a downstream surface and comprises an inlet surface, an outlet surface, and a transition surface extending between said inlet surface and said outlet surface; and wherein the flow channel extends between an inlet opening and an outlet opening, said inlet surface extending between said inlet opening and said transition surface and oriented substantially perpendicular with respect to said centerline axis to define a radial flow path at said inlet opening, said outlet surface extending between said outlet opening and said transition surface and oriented substantially parallel with respect to said centerline axis to define an axial flow path at said outlet opening.

7. A supersonic compressor system in accordance with claim 1, wherein:

the radially outer surface extends generally axially between an upstream surface and a downstream surface; and wherein the flow channel defines an axial flow path extending between said upstream surface and said downstream surface.

8. A supersonic compressor system comprising:

a casing defining a cavity extending between a fluid inlet and a fluid outlet;

a first drive shaft positioned within said cavity, wherein a centerline axis extends along a centerline of said first drive shaft;

a supersonic compressor rotor coupled to said first drive shaft and positioned in flow communication between said fluid inlet and said fluid outlet, said supersonic compressor rotor comprising a radially inner surface, a radially outer surface, an endwall extending between said radially inner surface and said radially outer surface in a radial direction; and a plurality of vanes coupled to said endwall, adjacent said vanes and said endwall defining a radial flow channel extending radially between said radially inner surface and said radially outer surface and at least one supersonic compression ramp disposed within said radially flow channel and configured to form at least one compression wave within said flow channel; and a compressor assembly positioned in flow communication between said supersonic compressor rotor and said fluid outlet, said compressor assembly configured to compress fluid received from said supersonic compressor rotor.

9. A supersonic compressor system in accordance with claim 8, further comprising an inlet guide vane assembly positioned in flow communication between said fluid inlet and said supersonic compressor rotor.

10. A supersonic compressor system in accordance with claim 8, wherein said compressor assembly is coupled to said first drive shaft, said first drive shaft configured to rotate each of said supersonic compressor rotor and said compressor assembly at a first rotational velocity.

11. A supersonic compressor system in accordance with claim 8, further comprising a second drive shaft rotatably coupled to said compressor assembly, wherein said first drive shaft is configured to rotate said supersonic compressor rotor at a first rotational velocity, and said second drive shaft is configured to rotate said compressor assembly at a second rotational velocity that is different than the first rotational velocity.

12. A supersonic compressor system in accordance with claim 11, wherein said first drive shaft is configured to rotate said supersonic compressor rotor in a first rotational direction, and said second drive shaft is configured to rotate said compressor assembly in a second rotational direction that is different than the first rotational direction.

13. A supersonic compressor system comprising:

a casing defining a cavity extending between a fluid inlet and a fluid outlet;

a first drive shaft positioned within said cavity, wherein a centerline axis extends along a centerline of said first drive shaft;

a supersonic compressor rotor coupled to said first drive shaft and positioned in flow communication between said fluid inlet and said fluid outlet, said supersonic compressor rotor comprising a radially outer surface and a plurality of vanes, adjacent said vanes and said radially outer surface defining a flow channel, said flow channel having disposed within it at least one supersonic compression ramp configured to form at least one compression wave for compressing a fluid within said flow channel; and a mixed-flow compressor assembly positioned in flow communication between said supersonic compressor rotor and said fluid outlet, said mixed-flow compressor assembly configured to compress fluid received from said supersonic compressor rotor.

14. A supersonic compressor system in accordance with claim 13, further comprising an inlet guide vane assembly positioned in flow communication between said fluid inlet and said supersonic compressor rotor.

15. A supersonic compressor system in accordance with claim 13, wherein said mixed-flow compressor assembly is coupled to said first drive shaft, said first drive shaft configured to rotate each of said supersonic compressor rotor and said mixed-flow compressor assembly at a first rotational velocity.

16. A supersonic compressor system in accordance with claim 13, further comprising a second drive shaft rotatably coupled to said mixed-flow compressor assembly, wherein said first drive shaft is configured to rotate said supersonic compressor rotor at a first rotational velocity, and said second drive shaft is configured to rotate said mixed-flow compressor assembly at a second rotational velocity that is different than the first rotational velocity.

17. A supersonic compressor system in accordance with claim 16, wherein said first drive shaft is configured to rotate said supersonic compressor rotor in a first rotational direction, and said second drive shaft is configured to rotate said mixed-flow compressor assembly in a second rotational direction that is different than the first rotational direction.

18. A supersonic compressor system in accordance with claim 13, wherein:

the radially outer surface extends generally axially between an upstream surface and a downstream surface; and wherein a plurality of vanes are coupled to said radially outer surface, adjacent said vanes defining an axial flow channel, said axial flow channel extending between said upstream surface and said downstream surface.

19. A supersonic compressor system in accordance with claim 13, wherein:

the radially outer surface of the rotor extends generally between an upstream surface and a downstream surface and comprises an inlet surface, an outlet surface, and a transition surface extending between said inlet surface and said outlet surface; and wherein the flow channel extends between an inlet opening and an outlet opening, said inlet surface extending between said inlet opening and said transition surface and oriented substantially perpendicular with respect to said centerline axis to define a radial flow path at said inlet opening, said outlet surface extending between said outlet opening and said transition surface and oriented substantially parallel with respect to said centerline axis to define an axial flow path at said outlet opening.

* * * * *